US005531542A

United States Patent [19]

Willis

[11] Patent Number: 5,531,542

[45] Date of Patent: Jul. 2, 1996

[54] DUAL AUGER/CONVEYOR DRIVE FOR A PAVER

[75] Inventor: Paul E. Willis, Orrstown, Pa.

[73] Assignee: Ingersoll-Rand Company, Woodcliff Lake, N.J.

[21] Appl. No.: 339,440

[22] Filed: Nov. 14, 1994

[51] Int. Cl.[6] ..... E01C 19/48

[52] U.S. Cl. ..... 404/101; 404/108

[58] Field of Search ..... 404/83, 85, 101, 404/108, 110, 118

[56] References Cited

U.S. PATENT DOCUMENTS

| | | | |
|---|---|---|---|
| 3,015,258 | 1/1962 | Apel et al. . | |
| 3,128,831 | 4/1964 | Arndt . | |
| 3,359,875 | 12/1967 | Reider . | |
| 3,901,616 | 8/1975 | Greening | 404/102 |
| 3,967,912 | 7/1976 | Parker | 404/84 |
| 4,708,519 | 11/1987 | Davin et al. | 404/101 |
| 4,749,304 | 6/1988 | Craig | 404/101 |

OTHER PUBLICATIONS

"Hot–Mix Asphalt Paving Handbook", U.S. Army Corps of Engineers UN–13(CEMP–ET), Jul. 31, 1991, pp. 3–17 thru 3–39.

*Primary Examiner*—William P. Neuder
*Assistant Examiner*—Pamela A. O'Connor
*Attorney, Agent, or Firm*—John J. Selko

[57] ABSTRACT

A self propelled paving machine includes a pair of independently operated conveyors and a pair of independently operated augers spaced on opposite sides of the machine centerline. The augers can be separately raised and lowered to different elevations. The drive boxes for the conveyors and augers are positioned at the sides of the machine, to provide space between the conveyors and augers that is unobstructed, permitting the free fall of paving material from the conveyors along the centerline of the machine.

5 Claims, 4 Drawing Sheets

DUAL AUGER/CONVEYOR DRIVE FOR A PAVER

BACKGROUND OF THE INVENTION

This invention relates generally to asphalt paving machines using augers to distribute paving materials, and more particularly to asphalt paving machines that can raise and lower the augers above the surface being paved.

Prior art paving machines provide two independently driven conveyors and two independently driven augers positioned on either side of a longitudinal centerline along the machine. The two pairs of conveyors and augers have a common drive box positioned generally at the longitudinal centerline. Occasionally it becomes necessary to raise the elevation of the augers, and this is accomplished by pivoting the drive box and augers upwardly in an arc. Two problems are prevalent in this arrangement. First, there is no ability to raise only one auger at a time because both augers are connected to a single drive box. This eliminates the possibility of positioning the two augers at different elevations. Second, the centerline position of the drive box slightly obstructs the space between the end of the conveyor and the augers, thereby interfering with the free fall of paving material off of the conveyor. This contributes to segregation of paving material and makes for uneven paving.

The foregoing illustrates limitations known to exist in present paving machines. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a paving machine comprising a self propelled tractor carrying a first and second endless feed conveyor, the conveyors positioned on either side of a longitudinal centerline, the conveyors arranged to deliver paving material rearwardly from a hopper to a first and second transverse auger, the augers positioned on either side of the longitudinal centerline, the augers arranged to spread the material outwardly and deposit it onto the surface being paved forwardly of a leveling screed which trails the augers; drive box means mounted at the rear of the tractor adjacent each side edge thereof, for rotatably supporting and drivingly engaging the first and second augers independently from each other; support member means spaced above the first and second augers, extending laterally between the drive box means at each side edge, for supporting the augers; controllable power actuator means for moving the first and second augers upwardly and downwardly independently from each other; and the first and second augers and the first and second conveyors defining an unobstructed space therebetween generally at the longitudinal centerline for paving material to fall freely from the conveyors.

The foregoing and other aspects will become apparent from the following detailed description of the invention when considered in conjunction with the accompanying drawing figures.

BRIEF DESCRIPTION OF THE DRAWING FIGURES

FIG. 1 is a schematic plan view of a prior art paving machine, with parts removed;

FIG. 2 FIG. 2 is an elevational view, with parts removed, looking forward, of the auger mechanism of this invention;

DETAILED DESCRIPTION

Figure 1:
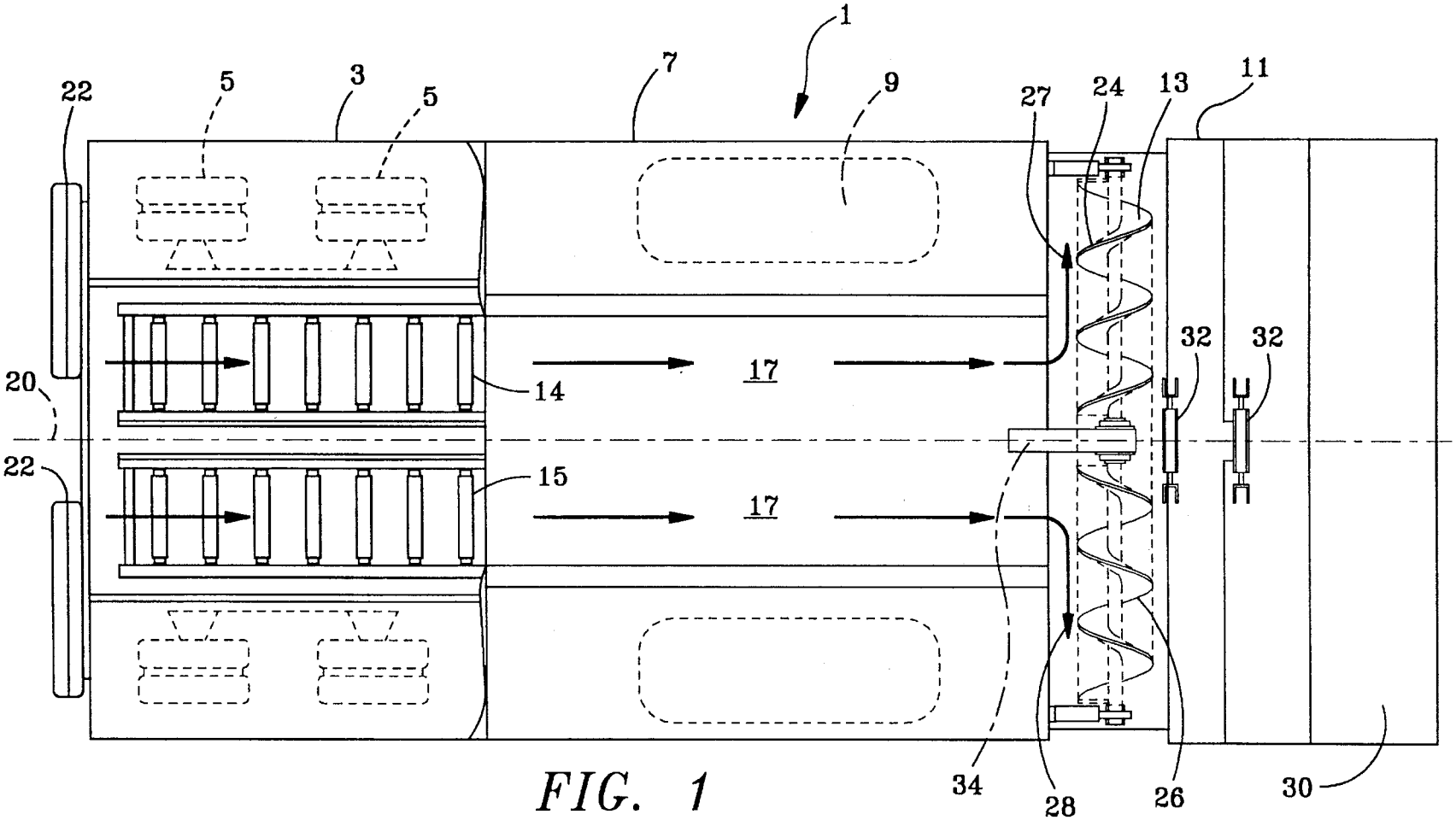
FIG. 1 (PRIOR ART)
Figure 2:
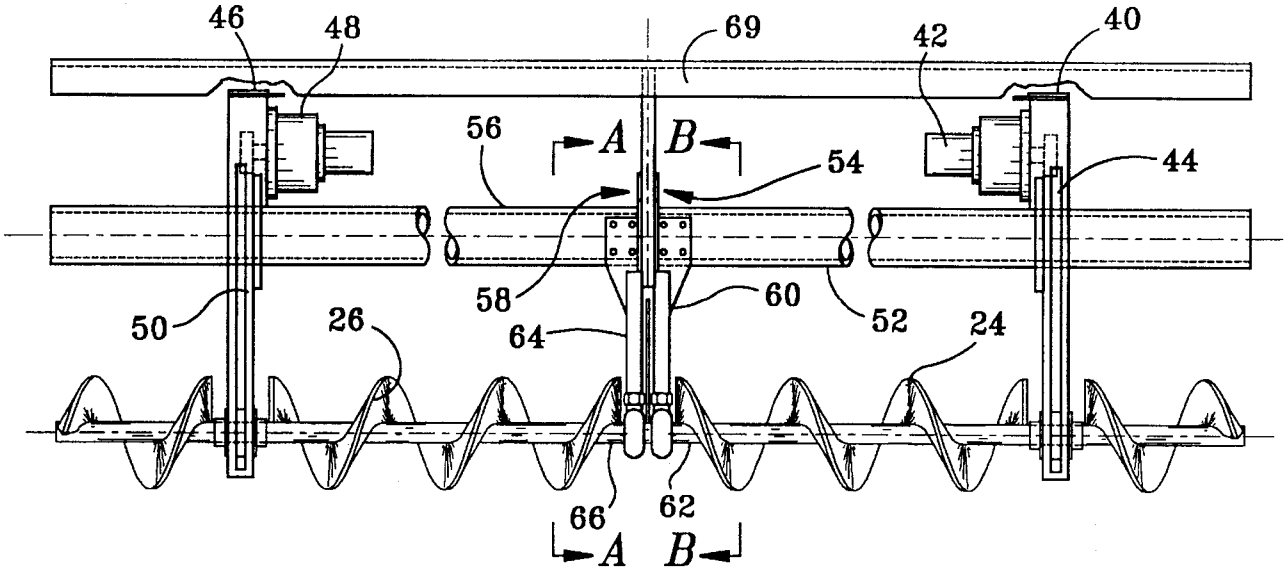

FIG. 1 shows a prior art asphalt paving machine 1 having a hopper 3 mounted on wheels 5 with a main cab 7 mounted on pneaumatic wheels 9. A floating screed 11 is pulled behind cab 7. An auger mechanism 13 is mounted on cab 7 between cab 7 and screed 11. A pair of conveyors 14, 15 form the floor of hopper 3, and move paving material from hopper 3 in the direction of arrows 17. Each hopper 3 is positioned on opposite sides of a longitudinal centerline 20 of machine 1. Paving material is fed into hopper 3 from a vehicle (not shown) that is positioned against contact rollers 22 on the front of the moving paver 1. Paving material moves rearwardly under the cab 3 and falls onto the auger mechanism 13. Auger mechanism 13 is formed by a pair of augers 24, 26 one auger positioned on opposite sides of centerline 20. The augers 24, 26 move the material outwardly in the direction of arrows 27, 28. Screed 11 levels the paving material into a flat mat 30. A crown may be placed on mat 30 by crown adjustment devices 32. A drive box 34 is positioned on centerline 20 to actuate conveyors 14, 15 and augers 24, 26. The drive box 34 slightly obstructs the space between augers 24, 26 and conveyors 14, 15, interfering with the free fall of material from the conveyors 14, 15 along centerline 20. Conveyors 14,15 and augers 24, 26 may be operated independently, but must be raised and lowered simultaneously due to the common connection to drive box 34.

FIGS. 2–5 show the mechanism of this invention. A first drive box means 40 is mounted at a first side edge of machine 1 for rotatably supporting first auger 24 and first conveyor 14. A conventional first hydraulic motor 42 actuates first conveyor 14 and first auger 24 by means of a conventional chain and sprocket combination 44 connected to an end roll 45 (FIG. 3) of conveyor 14, auger 24 and motor 42. A second drive box means 44 is mounted at a second side edge of machine 1 for rotatably supporting second auger 26 and second conveyor 15. A conventional second hydraulic motor 48 actuates second conveyor 15 and second first auger 26 by means of a conventional chain and sprocket combination 50 connected to an end roll 51 of conveyor 15, auger 26 and motor 46. Motors 42, 48 have individual controls for independent operation.

The augers 24, 26 are further supported as follows: First tubular support member 52 extends above first auger 24 between first drive box means 40 and a first support bracket 54 positioned at centerline 20. Second tubular support member 56 extends above second auger 26 between second drive box means 46 and a second support bracket 58 positioned at centerline 20. Brackets 54, 58 are joined together and connected to a frame member 69 of machine 1.

Figure 3:
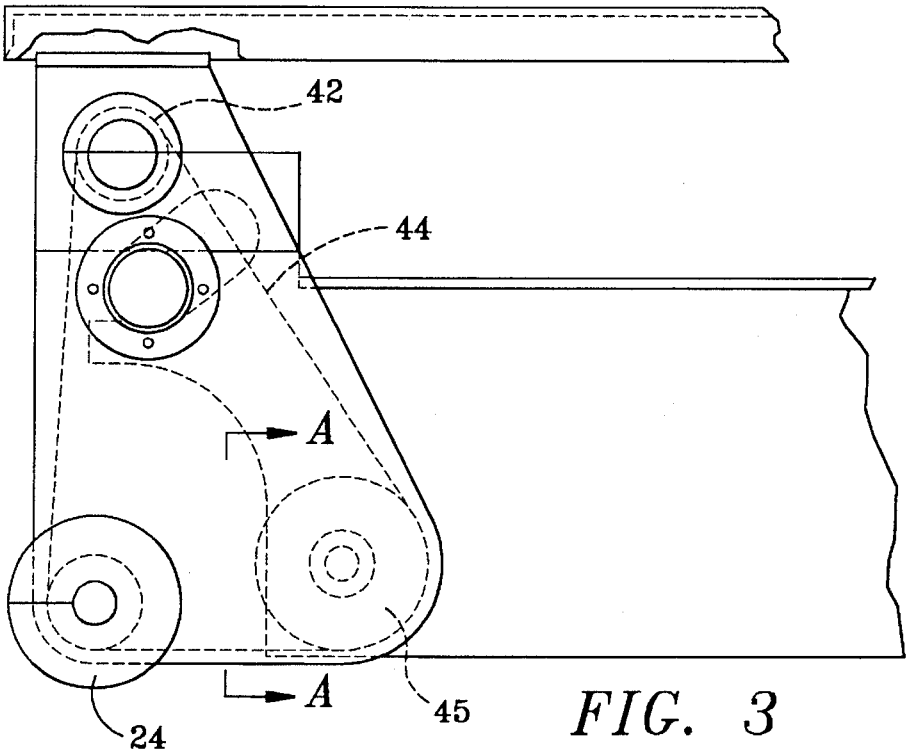
FIG. 3 is a side elevational view, with parts removed, of the mechanism of FIG. 2.
Figure 5:
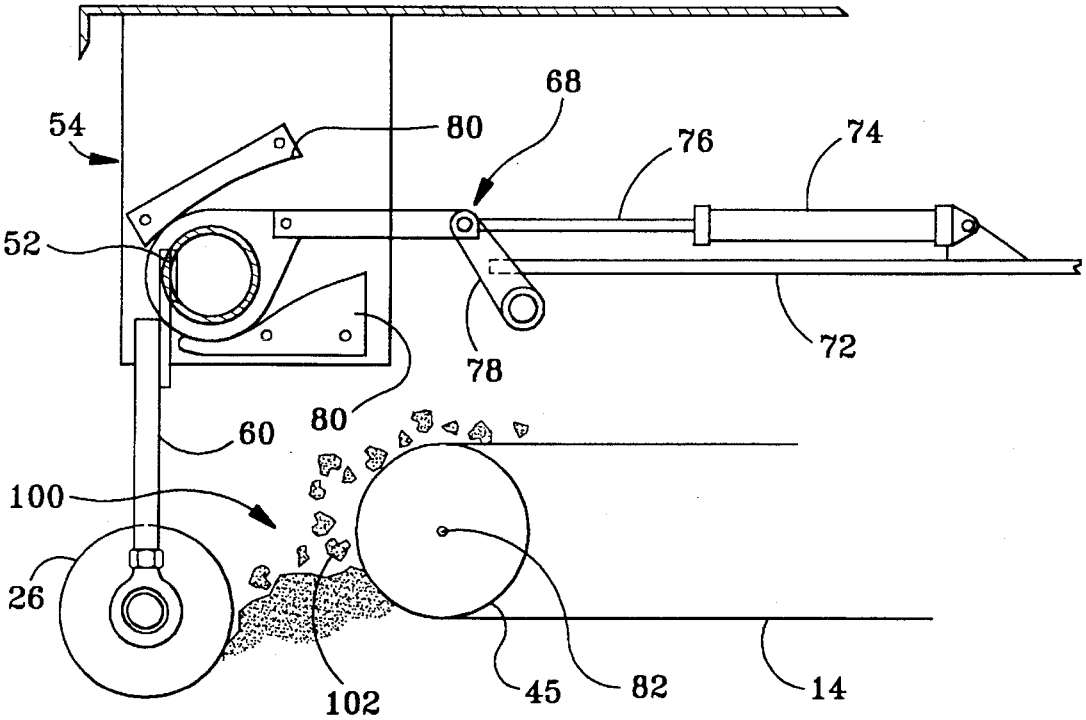
FIG. 5 is a view along B—B of FIG. 2.
Figure 6:
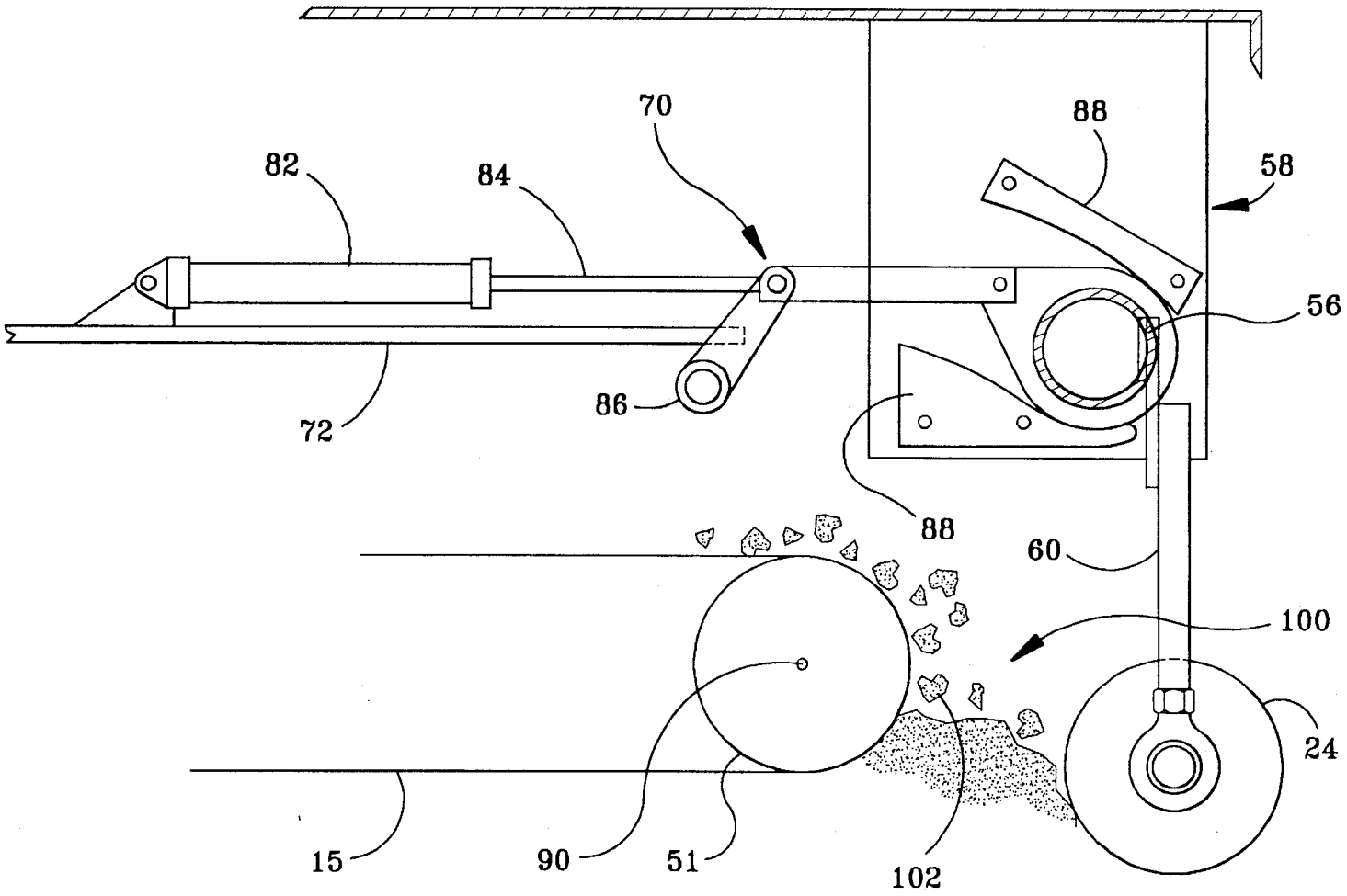
FIG. 6 is a view along C—C of FIG. 2.

As shown in FIGS. 3, 5 and 6, first bearing member 60 extends downwardly from first support member 52, adjacent centerline 20, and rotatably supports inboard ends of first auger shaft 62 of first auger 24. Second bearing member 64 extends downwardly from second support member 56, adjacent centerline 20, and rotatably supports inboard ends of second auger shaft 66 of second auger 26.

As shown in FIGS. 5 and 6 the augers 24, 26 are raised and lowered by a pair of separate, independently operated power actuators 68, 70. First power actuator 68 is mounted on frame 72 of machine 1, and includes a first hydraulic cylinder 74, having extendable rod 76 pivotally connected to crank arm 78, which is pivotally connected to first support member 52. As rod 76 retracts, support member 52 is pulled up along inclined sloped plates 80 to raise first auger 24 upwardly in an arc around pivot axis 82, which is the lateral centerline of end roller 45 of conveyor 14.

Second power actuator 70 is mounted on frame 72 of machine 1, and includes a second hydraulic cylinder 82, having extendable rod 84 pivotally connected to crank arm 86, which is pivotally connected to second support member 56. As rod 84 retracts, support member 56 is pulled up along inclined sloped plates 88 to raise second auger 26 upwardly in an arc around pivot axis 90, which is the lateral centerline of end roller 51 of conveyor 15. First and second power actuators 68, 60 are preferred to be positioned adjacent centerline 20.

Figure 4:
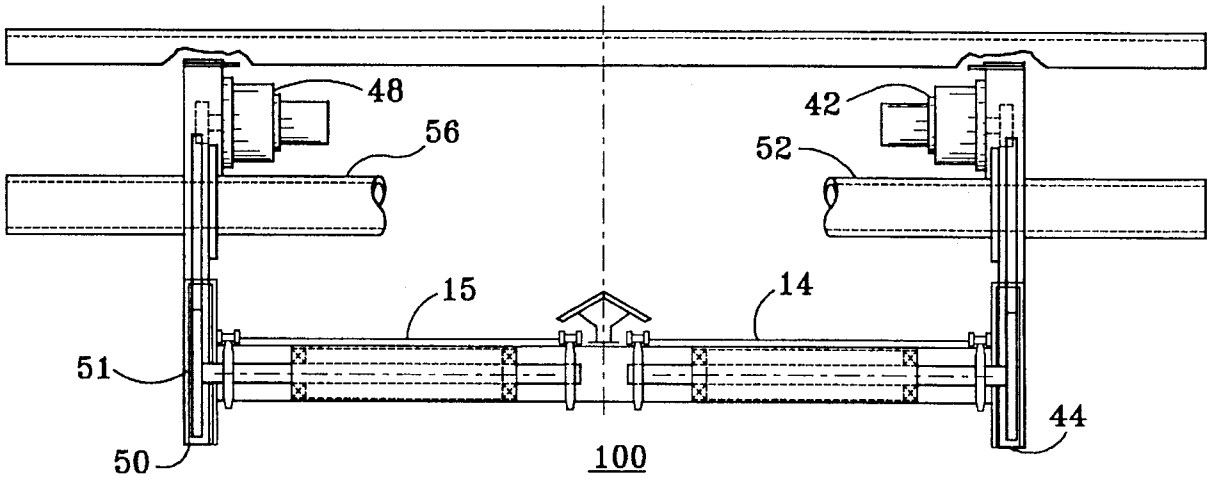
FIG. 4 is a view along A—A of FIG. 3.

As seen in FIGS. 4–6, the space 100, extending laterally and longitudinally between end rollers 45, 51 of conveyors 14, 15 and augers 24, 26 is unobstructed, permitting paving material 102 to fall freely onto centerline.

Having described the invention, what is claimed is:

1. In a paving machine comprising a self propelled tractor carrying a first and second endless feed conveyor, said conveyors positioned on either side of a longitudinal centerline, said conveyors arranged to deliver paving material rearwardly from a hopper to a first and second transverse auger, said augers positioned on either side of said longitudinal centerline, said augers arranged to spread the material outwardly and deposit it onto the surface being paved forwardly of a leveling screed which trails the augers, the improvement comprising:

a. drive box means mounted at the rear of said tractor adjacent each side edge thereof, for rotatably supporting and drivingly engaging said first and second augers independently from each other;

c. support member means spaced above said first and second augers, extending laterally between said drive box means at each side edge, for supporting said augers;

d. controllable power actuator means for moving said first and second augers upwardly and downwardly independently from each other; and e. said first and second augers and said first and second conveyors defining an unobstructed space therebetween generally at said longitudinal centerline for paving material to fall freely from said conveyors.

2. The paving machine of claim 1 wherein said drive box means comprises:

a. a first drive box means mounted at the rear of said tractor adjacent a first side thereof, for rotatably supporting and drivingly engaging said first auger; and b. a second drive box means mounted at the rear of said tractor adjacent a second side thereof, for rotatably supporting and drivingly engaging said second auger.

3. The paving machine of claim 2 wherein said support member means comprises:

a. first support member means extending above said first auger, extending between said first drive box means and a first support bracket positioned generally at said longitudinal centerline, for supporting said first drive box means and said first auger;

b. second support member means extending above said second auger, extending between said second drive box means and a second support bracket positioned generally at said longitudinal centerline, for supporting said second drive box means and said second auger;

c. first bearing member means extending downwardly from the said first support means adjacent said centerline, for rotatably supporting inboard portions of said first auger; and d. second bearing member means extending downwardly from said second support means adjacent said centerline, for rotatably supporting inboard portions of said second auger.

4. The paving machine of claim 3 wherein said power actuator means comprises:

a. first controllable power actuator means for moving said first drive box means and first auger upwardly and downwardly; and b. second controllable power actuator means for moving said second drive box means and second auger upwardly and downwardly.

5. In a paving machine comprising a self propelled tractor carrying a pair of endless feed conveyors, said conveyors positioned on either side of a longitudinal centerline, said conveyors arranged to deliver paving material rearwardly from a hopper to a pair of transverse augers, said augers positioned on either side of said longitudinal centerline, said augers arranged to spread the material outwardly and deposit it onto the surface being paved forwardly of a leveling screed which trails the augers, the improvement comprising:

a. a first drive box means mounted at the rear of said tractor adjacent a first side thereof, for rotatably supporting and drivingly engaging said first auger;

b. a second drive box means mounted at the rear of said tractor adjacent a second side thereof, for rotatably supporting and drivingly engaging said second auger;

c. first support member means extending above said first auger, extending between said first drive box means and a first support bracket positioned generally at said longitudinal centerline, for supporting said first drive box means and said firs auger;

d. second support member means extending above said second auger, extending between said second drive box means and a second support bracket positioned generally at said longitudinal centerline, for supporting said second drive box means and said second auger;

e. first bearing member means extending downwardly from the inboard ends of said first support means, for rotatably supporting inboard portions of said first auger;

f. second bearing member means extending downwardly from the inboard ends of said second support means, for rotatably supporting inboard portions of said second auger;

g. first controllable power actuator means for moving said first drive box means and first auger upwardly and downwardly;

h. second controllable power actuator means for moving said second drive box means and second auger upwardly and downwardly; and i. said first and second augers and said first and second conveyors defining an unobstructed aperture therebetween generally at said longitudinal centerline for paving material to fall freely from said conveyors.

* * * * *